US007344817B2

(12) United States Patent
Chou et al.

(10) Patent No.: US 7,344,817 B2
(45) Date of Patent: Mar. 18, 2008

(54) DRYING PROCESS FOR TONER PARTICLES USEFUL IN ELECTROGRAPHY

(75) Inventors: Hsin Hsin Chou, Woodbury, MN (US); Ronald J. Moudry, Woodbury, MN (US)

(73) Assignee: Samsung Electronics Co., Ltd. (KR)

( * ) Notice: Subject to any disclaimer, the term of this patent is extended or adjusted under 35 U.S.C. 154(b) by 389 days.

(21) Appl. No.: 10/881,637

(22) Filed: Jun. 30, 2004

(65) Prior Publication Data

US 2006/0003251 A1 Jan. 5, 2006

(51) Int. Cl.
*G03G 5/00* (2006.01)

(52) U.S. Cl. ..... 430/137.1; 430/137.11

(58) Field of Classification Search ..... 430/137.1, 430/137.11

See application file for complete search history.

(56) References Cited

U.S. PATENT DOCUMENTS

| | | | |
|---|---|---|---|
| 4,268,598 | A | 5/1981 | Leseman et al. |
| 4,321,404 | A | 3/1982 | Williams et al. |
| 4,728,983 | A | 3/1988 | Zwadlo et al. |
| 4,731,003 | A | 3/1988 | Maurilio et al. |
| 5,262,259 | A | 11/1993 | Chou et al. |
| 5,384,226 | A | 1/1995 | Kanakura et al. |
| 5,807,651 | A | 9/1998 | Rimai et al. |
| 6,103,781 | A | 8/2000 | Li et al. |
| 6,136,490 | A | 10/2000 | Ogawa et al. |
| 6,684,045 | B2 | 1/2004 | Viturro et al. |
| 2004/0091805 | A1 | 5/2004 | Qian et al. |
| 2004/0091806 | A1 | 5/2004 | Qian et al. |
| 2004/0091807 | A1 | 5/2004 | Qian et al. |
| 2004/0091808 | A1 | 5/2004 | Qian et al. |
| 2004/0091809 | A1 | 5/2004 | Qian et al. |

FOREIGN PATENT DOCUMENTS

| | | |
|---|---|---|
| JP | 05119529 | 5/1993 |

*Primary Examiner*—Mark A. Chapman
(74) *Attorney, Agent, or Firm*—Kagan Binder, PLLC

(57) ABSTRACT

The present invention relates to methods of drying and recovering toner particles from a liquid carrier. The methods are very effective to generate discrete, substantially non-agglomerated dry toner particles in a manner that preserves the particle size and particle distribution of the wet particles. The resultant dried toner particles free-flowing with a relatively narrow particle size distribution. The present invention uses electrical phenomena to help transfer charged toner particles from a liquid carrier onto a substrate surface. In practical effect, the particles are electrically plated onto the surface. Because the resultant coating has a relatively large drying surface area per gram of particle incorporated into the coating, drying may occur relatively quickly under moderate temperature and pressure conditions. After drying, the dried toner particles are readily recovered and may then be used in dry or even wet toners for electrophotographic applications.

33 Claims, 1 Drawing Sheet

DRYING PROCESS FOR TONER PARTICLES USEFUL IN ELECTROGRAPHY

FIELD OF THE INVENTION

The present invention relates to methods of making dried toner particles having utility in electrophotography (including electrographic and electrostatic printing processes). More particularly, the invention relates to improved methods for drying chemically prepared, toner particles that are dispersed in a liquid carrier in a manner such that aggregation, agglomeration, fusing, melting, or other forms of particle clumping are substantially minimized and indeed are eliminated as a practical matter except to a de minimis degree. The resultant dried particles are useful in both dry and even wet toners.

BACKGROUND OF THE INVENTION

Electrophotographic technology, also referred to as xerography, involves the use of electrophotographic techniques to form images on a receptor, such as paper, film, or the like. Electrophotographic technology is incorporated into a wide range of equipment including photocopiers, laser printers, facsimile machines, and the like.

A representative electrophotographic process involves a series of steps to produce an image on a receptor, including charging, exposure, development, transfer, fusing, and cleaning, and erasure. In the charging step, a photoreceptor is covered with charge of a desired polarity, either negative or positive typically. In the exposure step, an optical system forms a latent image of charge on the photoreceptor corresponding to the image to be formed on the receptor. In the development step, toner particles of the appropriate polarity are generally brought into contact with the latent image. The toner particles adhere to the latent image via electrostatic forces. In the transfer step, the toner particles are transferred imagewise onto a desired receptor. In the fusing step, the toner is melted and thereby fused to the receptor. An alternative involves fixing the toner to the receptor under high pressure with or without heat. In the cleaning step, residual toner remaining on the photoreceptor is removed. Finally, in the erasing step, the photoreceptor charge is reduced to zero to remove remnants of the latent image.

Two types of toner are in widespread, commercial use. These are liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles in that liquid toner particles are solvated to some degree and generally do not carry a triboelectric charge while solvated and/or dispersed in a liquid carrier.

A typical dry toner particle generally comprises a visual enhancement additive, e.g., a colored pigment particle, and a polymeric binder. The binder fulfills functions both during and after the electrophotographic process. With respect to processability, the character of the binder impacts charge holding, flow, and fusing characteristics. These characteristics are important to achieve good performance during development, transfer, and fusing. After an image is formed on the receptor, the nature of the binder impacts durability, adhesion to the receptor, gloss, and the like. Polymeric materials suitable in dry toner particles typically have glass transition temperatures over a wide range, e.g., from at least about 50° C. to 65° C. or more, which is higher than that of polymeric binders used in liquid toner particles.

In addition to the visual enhancement additive and the polymeric binder, dry toner particles may optionally include other additives. Charge control additives are often used in dry toner when the other ingredients do not, by themselves, provide the desired charge holding properties. Release agents may be used to help prevent the toner from sticking to fuser rolls when those are used. Other additives include antioxidants, ultraviolet stabilizers, fungicides, bactericides, flow control agents, and the like.

Dry toner particles have been manufactured using a wide range of fabrication techniques. One widespread fabrication technique involves melt mixing the ingredients, comminuting the solid blend that results to form particles, and then classifying the resultant particles to remove fines and larger material of unwanted particle size. External additives may then be blended with the resultant particles. This approach has drawbacks. First, the approach necessitates the use of polymeric binder materials that are fracturable to some degree so that comminution can be carried out. This limits the kinds of polymeric materials that can be used, including materials that are fracture resistant and highly durable. This also limits the kinds of colorants to be used, in that some materials such as metal flakes or the like, may tend to be damaged to too large a degree by the energy encountered during comminution. The amount of energy required by comminution itself is drawback in terms of equipment demands and associated manufacturing expenses. Also, material usage is inefficient in that fines and larger particles are unwanted and must be screened out from the desired product. In short, significant material is wasted. Recycling of unused material is not always practical to reduce such waste inasmuch as the composition of recycled material may tend to shift from what is desired.

Relatively recently, chemically grown toner material has been developed. In such methods, the polymeric binder is manufactured by solution, suspension, or emulsion polymerization techniques under conditions that form monodisperse, polymeric particles that are fairly uniform in size and shape. After the polymer material is formed, it is combined with other desired ingredients. Organosols have been developed for use in liquid toners. See, e.g., U.S. Pat. No. 6,103,781. Some have also been developed for dry toners. See, e.g., U.S. Pat. Nos. 6,136,490 and 5,384,226 and Japanese Published Patent Document No. 05-119529.

Unfortunately, the use of such organosols to make dry toner particles has proved to be substantially more challenging than the use of organosols to make liquid toner compositions. When the orgaonsol is dried to remove the liquid carrier as is necessary to make dry toner particles, the binder particles tend to agglomerate and/or aggregate into one or more large masses. Sometimes, this can be due to the heat required for drying, which causes the particles to melt or soften and thereby coalesce or fuse with other melted or softened particles. Such masses must be pulverized or otherwise comminuted in order to obtain dry toner particles of an appropriate size. The need for such comminution completely defeats a major advantage of using organosols in the first instance which is the formation of monodisperse, polymeric particles of uniform size and shape. Consequently, the full spectrum of benefits that result from using organosols has not been realized for widespread, commercial, dry toner applications.

Particle size and charge characteristics are especially important to form high quality images with good resolution.

Dry toner particles must be as uniform in size, charge rate, and charge holding characteristics as is practically possible in order to maximize image forming performance. Accordingly, there is always a demand in this industry for techniques that yield dry toner particles with more uniform particle size, charging rate, and/or charge holding characteristics.

SUMMARY OF THE INVENTION

The present invention relates to methods of drying and recovering toner particles from a liquid carrier. The methods are very effective to generate discrete, substantially non-agglomerated dried toner particles in a manner that preserves the particle size and particle distribution of the originally wet particles. The resultant dried toner particles free-flowing with a relatively narrow particle size distribution. Additionally, because the dried particles have uniform size characteristics, there is no need, if desired, for comminution and the associated particle size screening and classification. Consequently, materials are used efficiently and the intense energy of comminution is avoided, if desired.

As compared to conventional methods for drying toner particles, the present invention dramatically minimizes undesirable clumping, e.g., aggregation, agglomeration, or the like. The process, therefore, is especially useful to dry and recover chemically grown, dry toner particles from an organosol composition inasmuch as chemically grown toner particles tend to have favorable, monodisperse particle size and particle distribution characteristics.

As an overview, the present invention uses electrical phenomena to help transfer charged toner particles from a liquid carrier onto a substrate surface. In preferred aspects, this transfer occurs by establishing an electrical bias differential between a particle source and the substrate surface. In practical effect, the particles are electrically plated onto the surface. A relatively thin coating of plated particles results as a consequence. Because the resultant coating has a relatively large drying surface area per gram of particle incorporated into the coating, drying may occur relatively quickly under moderate temperature and pressure conditions. For instance, drying may occur at a temperature well below the effective glass transition temperature (Tg) of binder constituent(s) in the particles to avoid melting the particles to form a film, fusing the particles, or the like. After drying, the dried toner particles are readily recovered and may then be used in dry or even wet toners for electrography applications.

The drying process can be run in batch or continuous fashion. For continuous operation, the particles may be plated onto the surface of a moving web or belt in a manner suitable for large-scale, commercial production.

The use of the drying methodologies of the present invention also allows more flexibility in formulating toner particles and/or the liquid carrier in which the particles are dispersed. Because of the moderate temperatures that may be used for drying, relatively volatile organic solvents may be used that would otherwise be more difficult to handle with conventional oven drying. Similarly, the particles themselves can be formulated with low Tg (glass transition temperature) binder materials and/or temperature sensitive materials that would not be as easily handled if drying were to occur at higher temperatures at which the Tg or temperature sensitivity became an issue.

As used herein, the term "copolymer" encompasses both oligomeric and polymeric materials derived from two or more monomers. As used herein, the term "monomer" means a relatively low molecular weight material (i.e., having a molecular weight less than about 500 g/mole) having one or more polymerizable groups. "Oligomer" means a relatively intermediate sized molecule incorporating two or more monomers and having a molecular weight of from about 500 up to about 10,000 g/mole. "Polymer" means a relatively large material comprising a substructure formed two or more monomeric, oligomeric, and/or polymeric constituents and having a molecular weight greater than about 10,000 g/mole. The term "molecular weight" as used throughout this specification means weight average molecular weight unless expressly noted otherwise.

In one aspect, the present invention relates to method of drying charged toner particles. An admixture comprising the charged toner particles dispersed in a liquid carrier is provided. An electrical characteristic of a surface is used to help coatingly transfer the toner particles onto the surface. While the toner particles are coated onto the surface, the toner is at least partially dried. The toner particles are collected and incorporated into an electrophotographic toner.

In another aspect, the present invention relates to a method of marketing an electrophotographic toner product. An admixture comprising a plurality of charged toner particles dispersed in a liquid carrier is provided. A portion of the admixture is transferred to an electrically biased, moving web. The coated toner particles are at least partially dried. The dried toner particles are incorporated into an electrophotographic toner product. The electrophotographic toner product is marketed for use in imaging process.

In another aspect, the present invention relates to a toner drying apparatus. The apparatus includes an admixture supply comprising a plurality of charged toner particles dispersed in a liquid carrier. The apparatus further includes a biased, moving web having a surface and a biased roller positioned in a manner effective to help coatingly transfer wet, charged toner particles from the supply to the web surface. A drying zone is included in which the wet, charged toner particles coated on the web surface are at least partially dried. A recovery zone also is included in which at least a portion of the dried toner particles are removed from the web surface.

In another aspect, the present invention relates to a method of processing charged toner particles. Information indicative of how an electrical surface characteristic impacts a coating thickness of wet, charged toner particles on the surface is determined. The information is used to coat wet, charged toner particles onto the surface. The coated particles are dried. The dried particles are incorporated into an electrophotographic toner.

In another aspect, the present invention relates to a method of processing charged toner particles. Information indicative of how a roller speed characteristic of an electrically biased roller impacts a coating thickness of wet, charged toner particles onto a surface is determined. The information is used to coat wet, charged toner particles onto the surface. The coated particles are dried. The dried particles are incorporated into an electrophotographic toner.

In another aspect, the present invention relates to a method of processing charged toner particles. Information indicative of how a gap distance between an electrically biased roller and an electrically biased surface impacts a coating thickness of wet, charged toner particles onto the surface is determined. The information is used to coat wet, charged toner particles onto the surface. The coated particles are dried. The dried particles are incorporated into an electrophotographic toner.

BRIEF DESCRIPTION OF THE DRAWINGS

The understanding of the above mentioned and other advantages of the present invention, and the manner of attaining them, and the invention itself can be facilitated by reference to the following description of the exemplary embodiments of the invention taken in conjunction with the accompanying drawings, wherein.

DETAILED DESCRIPTION

Figure 1:
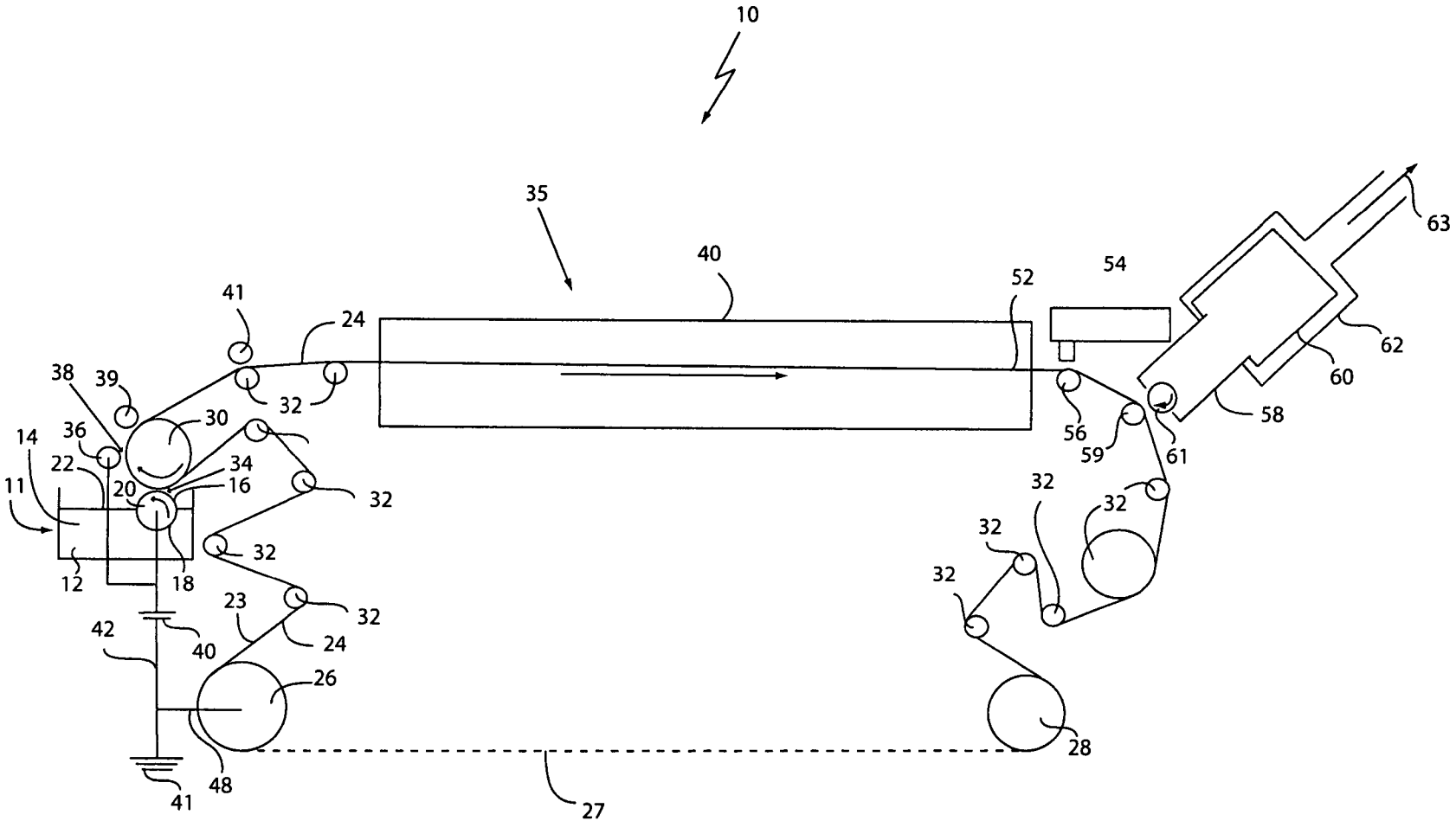
FIG. 1 is a schematic illustration of a drying apparatus of the present invention incorporating a coating station, a drying station, and a particle recovery station.

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

FIG. 1 shows one representative embodiment of a drying apparatus 10 suitable in the practice of the present invention for drying charged toner particles (not shown specifically) dispersed in an admixture 14 comprising the charged toner particles dispersed in a liquid carrier (not shown specifically). A typical admixture 14 might include from 3 weight percent to 60 weight percent, more typically 5 weight percent to 20 weight percent of toner particles based upon the total weight of the admixture 14. The process of the invention would work if an admixture was to have a content of toner particles outside these ranges, but performance could be less than optimum. For instance, if admixture 14 were to include a lower amount of toner particles, throughput would be less. Additionally, a greater amount of liquid carrier per unit weight of particles would be used. Further, if admixture 14 were to include a higher amount of toner particles, the viscosity of the admixture 14 would be higher, increasing power requirements and possibly making it more difficult to maintain the uniformity of admixture 14. It also is more difficult to electrically transfer particles from the admixture to an electrically conductive surface as the particle content increases. Furthermore, apparatus 10 could have to be run at slower speeds to accommodate the higher particle content, resulting in an overall reduction in throughput.

The charged toner particles may carry either a negative or positive charge. The charge characteristics of the particles are most commonly either inherently present when the particles are dispersed in the liquid carrier or may be provided chemically in accordance with conventional practices now or hereafter developed. For purposes of discussion, apparatus 10 will be described in the context of toner particles that carry a positive charge while dispersed in the liquid carrier.

Apparatus 10 includes coating station 11 at which admixture 14 is coated onto surface 23 of a moving web 24. Coating station 11 includes as one component reservoir 12 that holds admixture 14 containing the charged toner particles dispersed in the liquid carrier. Other components of this embodiment of coating station 11 include deposition roller 16, coating station roller 30, optional calender rolls 36 and/or 39, voltage source 40 and its various electrical connections to other components of coating station 11. Although not shown, reservoir 12 optionally may include a mixing device to help keep the toner particles uniformly dispersed in the liquid carrier. A deposition roller 16 is rotatably mounted within reservoir 12 so that deposition roller 16 is partially submerged in admixture 14 as roller 16 rotates. Thus, a lower portion 18 of deposition roller 16 is submerged within admixture 14, while an upper portion 20 of deposition roller 16 projects above surface 22 of admixture 14. The rotational axis of deposition roller 16 may be fixed or may be adjustable so that the height of deposition roller 16 may be changed in the event that the level of surface 22 varies during drying operations.

Deposition roller 16 is coupled to voltage source 40 via line 42 so as to provide deposition roller 16 with an electrical bias. The admixture is brought up to the gap 34 with the rotation of deposition roller 16 because of the admixture viscosity. While the toner particles are positively charged, the bias of the deposition roller 16 desirably is positive so as to force the toner particles from the rotating deposition roller 16 onto the web 24, which is at a lower bias, e.g., preferably being grounded. The electrical field between the positively biased deposition roller 16 and the preferably grounded web 24 causes the toner particles to transfer to the web 24. If the particles were negatively charged as might be the case in other embodiments, the bias on roller 16 would be negative. The magnitude of the bias applied to roller 16 may vary over a wide range. However, if the bias is too low (too close to the potential of the web, in this case, grounded), then the degree to which the particles are plated to web surface 23 may be less than might be desired, resulting in few toner particles being transferred to the web surface 23. On the other hand, if the bias were too large, then the plated toner thickness might be too thick to achieve the desired degree of drying in a desired time period. Balancing these concerns, exemplary embodiments of apparatus 10 biases deposition roller 16 to a positive voltage relative to a ground 44 in the range of 5 volts to 1500 volts, preferably 20 volts to 1000 volts, more preferably 50 to 700 volts. In one actual embodiment, a voltage of 100 volts was found to be suitable.

As deposition roller 16 rotates, roller 16 continuously supplies wet toner particles from admixture 14 to the gap 34 and forces these wet particles onto surface 23 of a moving web 24 that is conveyed from supply roll 26 to take up roll 28. Desirably, web 24 may be reused. For instance, if the supply and take up rolls 26 and 28 are similar, the positions of these may be swapped when the supply of web 24 is used up, after which the web would be re-threaded through apparatus 10 to begin drying operations anew. Web 24 may also be rewound from take up roll 28 to supply roll 26 if desired. In alternative embodiments web 24 may be a continuous belt as demonstrated schematically by dashed line 27.

To facilitate electrostatic transfer of particles from electrically biased deposition roller 16 onto surface 23, surface 23 is maintained at a lesser bias than that of roller 16. In the particular embodiment of apparatus 10 as shown, this bias differential is established by coupling surface 23 to ground 44 via line 48. Grounding of surface 23 helps to maximize the bias differential, and therefore the coating potential, between roller 16 and surface 23. In short, electrical charge characteristics of the toner particles are used to help plate the particles from reservoir 12 onto web surface 23 of moving web 24, where the transferred particles are more easily and effectively dried.

In practical effect, the bias differential between roller 16 and surface 23 causes particles in gap 34 to be electroplated onto surface 23. Electroplating of the particles onto web 24 has significant advantages. Firstly, plating allows very thin layers of wet toner particles to be consistently formed onto the surface of a moving web. As a consequence, and compared to drying the bulk admixture, drying a filter cake, drying the solids retained from a decant, or the like, the drying surface area of the toner particles plated in relatively thin layers onto the surface 23 of web 24 per gram of toner particles is magnified many, many times, e.g, by three orders of magnitude at least. This leads to faster, more economical drying at moderate temperatures. The procedure enables large scale, commercial drying of toner particles while avoiding undue clumping of toner particles that might tend to accompany conventional bulk drying, filter drying, or drying after a decant. This is especially useful for preserving the monodisperse character toner particles that are chemically grown in organic liquid carriers. Because drying may be carried out at relatively low temperatures at reasonable rates, the process may also be used to dry toners comprising temperature sensitive ingredients and/or ingredients that might otherwise form films at conventional drying temperatures.

Web 24 may be formed from any suitable material or combination of materials so long as web 24 has at least an electrically conductive surface 23 to allow the electrical bias differential to be established. Web 24 also should have appropriate tensile and other mechanical properties so as to have a reasonably long service life. A representative embodiment of web 24 includes an aluminized polyester film composite in which an approximately 0.1 μm (1000 Å) thick layer of aluminum is formed on an approximately 4.0 mil thick (100 μm) polyester substrate.

As web 24 is conveyed from take up roll 26 to supply roll 28, web 24 is supported by coating station roller 30 and various other guide rollers 32. Coating station roller 30 is positioned proximal to deposition roller 16 in a manner effective to help maintain particle plating gap 34 formed between deposition roller 16 and surface 23, and thereby facilitate consistent, uniform, electrically motivated transfer of toner particles brought to the gap 34 by deposition roller 16 to web 24. Gap 34 is needed to maintain the bias differential between roller 16 and surface 23. The dimension of gap 34 influences the thickness of particles plated onto web 24. As gap 34 becomes narrower, the coating will tend to be thicker. As gap 34 becomes wider, the coating will tend to be thinner.

As general guidelines, to provide a coating thickness that allows reasonable throughput, the gap dimension needs to be significantly larger than the final coating thickness will be. For example, it is common for the coating thickness to be as low as 10% of the original gap width. A gap dimension in the range of from about 10 to about 100, more preferably from about 20 to about 50 times the average toner particle diameter is preferred (i.e., the coating is on the order of a few particles in thickness). Generally, this corresponds to a coating that has a thickness up to about 500 micrometers, preferably up to about 125 micrometers. In one embodiment, a gap dimension of about 10 mils (equal to about 20 to about 30 times the average toner particle diameter for typical amphipathic polymer-based toner particles) would be suitable. Although not shown, the various rollers 32 are grounded for safety.

As wet toner particles are transferred from reservoir 12 onto web 24, the initial content of liquid carrier in the wet, electroplated particles is typically is only moderately reduced relative to the liquid carrier content in the reservoir 12. Accordingly, it is preferred that additional amounts of liquid carrier be physically removed from the wet particles to facilitate faster drying. This is readily accomplished by moderately squeezing the plated particles, such as by passing the plated web 24 between at least one pair of calendering rolls. If the coating station roller 30 is sufficiently oversized relative to deposition roller 16, coating station roller 30 may be one roller of one or more such pairs. For instance, downstream from deposition roller 16, at least one optional calendering roll 36 is positioned proximal to coating station roller 30 in a manner effective to maintain calendering gap 38 between calendering roll 36 and coating station roller 30. As plated web 24 passes through gap 38, some portion of liquid carrier is squeezed from the wet particles. The pressure of such calendering should be moderate so that the particulate nature of the toner particles is preserved. If the calendering pressure is too great, undue portions of particles undesirably may be pressed to form a film.

The use of at least one additional calendering gap may be desirable to remove even further amounts of liquid carrier from the wet, plated toner particles. Thus, coating station roller 30 may also constitute one member of another calendering pair along with optional, calender roll 39. In other embodiments, an additional calendering roll 41 may be used.

When one or more optional calendering rolls such as rolls 36, 39 and 41 are used, an electrical bias is also desirable applied to these to help ensure that material on web 24 is not unduly transferred from web 24 onto these rolls 36. Desirably, such electrical bias is greater than that applied to deposition roller 16 to minimize the risk of inadvertent particle transfer to the calender rolls. For example, in one embodiment of the invention in which an electrical bias of 100 volts is applied to the deposition roller 16, applying an electrical bias of 150 volts to calender roll 36 would be suitable. Note that calender rolls 39 and 41 would be biased, too, in a similar fashion, although this is not shown for purposes of clarity.

Downstream from the coating station components, web 24 passes through a drying station 35 in order to remove the remaining liquid carrier to the desired degree. Most commonly, the toner particles may be deemed to be dry when the particles can contain less than about 20 weight percent, preferably less than about 10 weight percent, and more preferably less than about two weight percent, of liquid carrier based upon the total weight of the liquid carrier and the toner particles.

Drying preferably may be carried out in an oven 40 as shown. Web 24 enters oven 40 via and entry port 50 and exits via exit port 52. As shown, web 24 bearing the plated, wet toner particles travels along a generally linear path through oven, although in other embodiments the path taken by web 24 may be nonlinear, e.g., zigzag, back and forth, etc., if it is desired to lengthen the path and increase residence time in the oven 40. Generally, the length of the web path through oven 40, and hence the residence time, is long enough to dry the plated toner particles to the desired degree. Residence time may be impacted by factors such as the nature of the liquid carrier, the bias differential between deposition roller 16 and surface 23 (and hence coating thickness of particles on web 24), the oven temperature, the oven pressure, web speed, and the like. Typical path lengths for web speeds in the range of 0.5 to 100 feet per minute range from 10 feet to 100 feet. In one representative mode of practice, a 20 foot long web path through an oven maintained at 40° C. would be suitable for a web speed of 5 feet per minute when the average coating thickness of particles on web 24 is in the range of from about 2 to about 10 times the average particle diameter of the toner particles.

It is a distinct advantage of the invention that drying may occur at moderate temperatures that are below the effective Tg of the polymer constituent(s) of the toner particles.

Generally, the effective Tg of the polymer constituents of the wet toner particles will be suppressed to some degree relative to the Tg of these same constituent(s) when dry. Drying desirably occurs below this effective Tg to help avoid melting the particles and forming a film. More desirably, drying occurs at a temperature that is at least 5° C., more preferably 5° C. to 25° C., and most preferably 10° C. to 20° C. below such effective Tg. In one suitable mode of practice, setting the oven at 40° C. when drying tone particles containing a polymer with an effective Tg of 65° C. when wet would be suitable.

Drying economically and conveniently may occur at ambient pressure in the ambient atmosphere. However, drying may occur at other pressures and/or in other atmospheres, if desired. For instance, if it is desired to protect the drying toner particles against oxidation, the toner particles can be dried in an inert atmosphere such as nitrogen, argon, $CO_2$, combinations of these, and the like. Further, to facilitate more rapid removal of liquid carrier at moderate temperatures, drying may occur at a reduced pressure.

After emerging from oven 40, the dried toner particles themselves tend to no longer bear an electrical charge, except however that the coated web at this point may bear triboelectric charges due to static charge build up. Accordingly, downstream from oven 40, an optional deionizer unit 54 operationally engages web 24 to help eliminate such triboelectric charging. A back up roller 56 helps to maintain appropriate positioning between the deionizer unit 54 and web 24.

After optional deionizing, the dried toner particles may be removed from web 24 at particle removal station 57. A preferred embodiment of removal station includes a rotatable brush roller 61 that helps to physically brush and thereby dislodge the dried toner particles from surface 23 of web 24. Rotatable brush roller 61 is housed inside conduit 58, which is under a vacuum from a source (shown schematically by arrow 63). The vacuum draws the particles through the conduit 58 and into vacuum bag 60 housed inside vacuum chamber 62. The collected toner particles may then be collected for subsequent use as a dry toner in imaging and other electrography applications. A back up roller 59 helps to maintain appropriate positioning between the brush 61 and web 24.

The rotational speed of the deposition roller 16 and the linear speed of web 24 each impacts, both singly and in combination, the plating rate, and hence coating thickness, of particles plated onto surface 23. In order for proper plating to occur, the gap 34 preferably is suitably and continously filled to the desired degree, and preferably is substantially filled with the liquid toner at all times during coating operations. To maintain this preferred gap-filled condition, the linear speed of the web 24 should be less than the surface speed of the deposition roller 16. Otherwise, the particular rotational speed(s) of the deposition roller 16 and the particular linear speed of web 24 are not critical and may be selected within a wide range. However, if the rotational speed of roller 16 is too low for a given web speed, then the actual plating of particles onto web 24 realized in practice may be less than the reasonable throughput capacity of apparatus 10. If the rotational speed is too high for a given web speed, then more particles may be plated to the surface 23 than can be reasonably dried given the nature of the drying station 35. In actual practice, operating the deposition roller 16 at a rotational speed in the range of from about 12 to about 600 rpm, preferably about 60 to about 240 rpm would be suitable. In one illustrative mode of practice, rotating a deposition roller 16 having a diameter of 0.89 inches (2.3 cm) at a speed of 60 rpm (corresponding to a surface speed of 2.8 inches/s (7.1 cm/s)) when the web 24 is moving at a speed of 5 feet/min would be suitable.

Similarly, if the linear speed of web 24 were to be too low for a given rotational speed of roller 16, then the coating thickness of particles plated onto web 24 would tend to increase. If the linear speed of web 24 were to be too fast for a given rotational speed of roller 16, then the coating thickness of particles plated onto web 24 would tend to decrease. In actual practice, operating the web 24 at a linear speed in the range of from about 1 to about 100 feet per minute, preferably about 5 to about 50 feet per minute would be suitable. In one illustrative mode of practice, operating the web 24 at a linear speed of 5 feet per minute was found to be suitable.

The relative relationship between the rotational speed of roller 16 and the linear speed of web 24 also may impact performance. It is desirable to coordinate the speeds of the two components to help ensure the uniform, consistent transfer of particles onto web 24. The amount of liquid toner being carried up by the rotation of roller 16 to the gap 34 is a balance of the viscosity of the toner, the speed of the rotation, the distance between the surface 22 and gap 34 and the gravitation force acting on the liquid toner on the surface of the deposition roller 16. At very high roller 16 speeds, the viscosity of the toner tends to decrease and accordingly, the amount of liquid toner carried by the roller surface would also decrease. It is usually helpful to generally establish the rotational speed of roller 16 first. As guidelines, the rotational speed of roller 16 may be set up to any rotational speed until so that admixture 14 does not unduly drip if the speed is too slow or get flung off if the speed is too fast. For optimum throughput, the preferred maximum speed occurs when roller 16 generally is substantially full of admixture 14 to transfer to web 24 without the admixture 14 being flung off the rotating roller 16. When the desired rotational speed is obtained, a corresponding web speed may be set. A range of speeds is available.

In some embodiments, it may be desired to form a discontinous coating. A discontinous coating has a moderately increased drying surface area relative to a continuous coating and will tend to dry faster. A discontinuous coating, if desired, easily may be achieved by varying the bias of the development roller, e.g., by electronically or manually turning the bias potential to the development roller 16 on and off.

In preferred modes of practice, the ratio of the linear speed of the surface of roller 16 as it rotates to the linear speed of the web is desirably in the range of from about 1:1 to about 10:1, preferably from greater than 1:1 to about 5:1. In one illustrative mode of practice, a ratio of 2.8 would be suitable. This ratio may be calculated according to the expression $\omega\pi D/V$, wherein $\omega$ is the rotational speed of the roller 16 in rpm, D is the diameter of roller 16 in centimeters, $\pi$ may be approximated by 3.14, and V is the linear speed of web 24 in cm/minute.

A wide variety of toner particles may be dried in the practice of the present invention. Generally, suitable toner particles generally include at least one visual enhancement additive, e.g., a colorant particle, and a polymeric binder derived from one or more resin materials. Preferred toner particles are chemically grown in a suitable liquid carrier. More preferred toner particles are chemically grown and incorporate a polymeric binder that includes and amphipathic copolymer derived from two or more monomers. As used herein, the term "amphipathic" is well known and refers to a copolymer having a combination of portions having distinct solubility and dispersibility characteristics, respectively, in a desired liquid carrier that is used to make the copolymer and/or used in the course of incorporating the copolymer into the dry toner particles. Preferably, the liquid carrier is selected such that at least one portion (also referred to herein as S material or block(s)) of the copolymer is more solvated by the carrier while at least one other portion (also referred to herein as D material or block(s)) of the copolymer constitutes more of a dispersed phase in the carrier.

In preferred embodiments, the amphipathic copolymer is polymerized in situ in the desired liquid carrier as this yields relatively monodisperse, copolymeric particles suitable for use in toner with little, if any, need for subsequent comminuting or classifying. The resulting organosol is then mixed with at least one visual enhancement additive and optionally one or more other desired ingredients. During such mixing, ingredients comprising the visual enhancement particles and the amphipathic copolymer will tend to self-assemble into composite toner particles. Specifically, it is believed that the D material of the copolymer will tend to physically and/or chemically interact with the surface of the visual enhancement additive, while the S material helps promote dispersion in the carrier. The resultant dispersed toner particles may then be dried and recovered in accordance with the drying methodology described herein.

The weight average molecular weight of the amphipathic copolymer of the present invention may vary over a wide range. Generally, copolymers having a weight average molecular weight in the range of 1000 to about 1,000,000 g/mol, preferably 5000 to 400,000 g/mole, more preferably 50,000 to 300,000 g/mole.

The relative amounts of S and D blocks can impact the solvating and dispersability characteristics of these blocks. For instance, if too little of the S block(s) are present, the copolymer may have too little stabilizing characteristics to sterically-stabilize the organosol with respect to aggregation as might be desired. If too little of the D block(s) are present, the small amount of D material may be too soluble in the liquid carrier such that there may be insufficient driving force to form a distinct particulate, dispersed phase in the liquid carrier. The presence of both a solvated and dispersed phase helps the ingredients of the triboelectrically charged particles self assemble in situ with exceptional uniformity among separate particles. Balancing these concerns, the preferred weight ratio of D block material to S block material is in the range of 1:20 to 20:1, preferably 1:1 to 15:1, more preferably 2:1 to 10:1, and most preferably 4:1 to 8:1.

The polydispersity of the copolymer also tends to impact imaging and transfer performance of the resultant dry toner material. Generally, it is desirable to maintain the polydispersity (the ratio of the weight-average molecular weight to the number average molecular weight) of the copolymer below 15, more preferably below 5, most preferably below 2.5. It is a distinct advantage of the present invention that copolymer particles with such lower polydispersity characteristics are easily made in accordance with the practices described herein, particularly those embodiments in which the copolymer is formed in the liquid carrier in situ.

Glass transition temperature, Tg, refers to the temperature at which a polymer, or portion thereof, changes from a hard, glassy material to a rubbery, or viscous, material. In the practice of the present invention, values for Tg are determined by differential scanning calorimetry. The glass transition temperatures (Tg's) of the S and D blocks may vary over a wide range and may be independently selected to enhance manufacturability and/or performance of the resulting dry toner particles. The Tg's of the S and D blocks will depend to a large degree upon the type of monomers constituting such blocks. Consequently, to provide a block with higher Tg, one can select one or more higher Tg monomers with the appropriate solubility characteristics for the type of block in which the monomer(s) will be used. Conversely, to provide a block with lower Tg, one can select one or more lower Tg monomers with the appropriate solubility characteristics for the type of block in which the monomer(s) will be used.

For triboelectrically charged particles useful in dry toner applications, the D block(s) preferably should not have a Tg that is too low or else receptors printed with the toner may experience undue blocking. Consequently, it is preferred that the Tg of the D material be far enough above the expected maximum storage temperature of a printed receptor so as to avoid blocking issues. Desirably, therefore, D material preferably has a Tg of at least 20° C., more preferably at least 30° C., most preferably at least about 50° C. Blocking with respect to the S block material is not as significant an issue inasmuch as preferred copolymers comprise a majority of the D block material. Consequently, the Tg of the D block material will dominate the effective Tg of the copolymer as a whole. However, if the Tg of the S block is too low, then the particles might tend to aggregate and/or aggregate during drying. On the other hand, if the Tg is too high, then the requisite fusing temperature may be too high. Balancing these concerns, the S block material is formulated to have a Tg of at least 20° C., preferably at least 40° C., more preferably at least 60° C.

The Tg can be calculated for a (co)polymer, or portion thereof, using known Tg values for the high molecular weight homopolymers (see, e.g., Table I herein) and the equation expressed below:

$$1/Tg = w_1/Tg_1 + w_2/Tg_2 + \ldots w_i/Tg_i$$

wherein each $w_n$ is the weight fraction of monomer "n" and each $Tg_n$ is the glass transition temperature of the high molecular weight homopolymer of monomer "n" as described in Wicks, A. W., F. N. Jones & S. P. Pappas, Organic Coatings 1, John Wiley, NY, pp 54-55 (1992).

A wide variety of one or more different monomeric, oligomeric and/or polymeric materials may be independently incorporated into the S and D blocks, as desired. Various embodiments of S and D blocks suitable in the practice of the present invention are described, for example, in the following co-pending applications of the present Assignee, each of which is incorporated herein by reference in its respective entirety:

- U.S. Ser. No. 10/612,243, filed Jun. 30, 2003, entitled "ORGANOSOL INCLUDING AMPHIPATHIC COPOLYMERIC BINDER AND USE OF THE ORGANOSOL TO MAKE DRY TONERS FOR ELECTROGRAPHIC APPLICATIONS"
- U.S. Ser. No. 10/612,535, filed Jun. 30, 2003, entitled "ORGANOSOL INCLUDING AMPHIPATHIC COPOLYMERIC BINDER HAVING CRYSTALLINE MATERIAL, AND USE OF THE ORGANOSOL TO MAKE DRY TONERS FOR ELECTROGRAPHIC APPLICATIONS"
- U.S. Ser. No. 10/612,534, filed Jun. 30, 2003, entitled "ORGANOSOL LIQUID TONER INCLUDING AMPHIPATHIC COPOLYMERIC BINDER HAVING CRYSTALLINE COMPONENT"
- U.S. Ser. No. 10/612,765, filed Jun. 30, 2003, entitled "ORGANOSOL INCLUDING HIGH TG AMPHIP-

ATHIC COPOLYMERIC BINDER AND LIQUID TONERS FOR ELECTROPHOTOGRAPHIC APPLICATIONS"

U.S. Ser. No. 10/612,533, filed Jun. 30, 2003, entitled "ORGANOSOL INCLUDING AMPHIPATHIC COPOLYMERIC BINDER MADE WITH SOLUBLE HIGH TG MONOMER AND LIQUID TONERS FOR ELECTROPHOTOGRAPHIC APPLICATIONS"

U.S. Ser. No. 10/612,182, filed Jun. 30, 2003, entitled "GEL ORGANOSOL INCLUDING AMPHIPATHIC COPOLYMERIC BINDER HAVING SELECTED MOLECULAR WEIGHT AND LIQUID TONERS FOR ELECTROPHOTOGRAPHIC APPLICATIONS"

U.S. Ser. No. 10/612,058, filed Jun. 30, 2003, entitled "GEL ORGANOSOL INCLUDING AMPHIPATHIC COPOLYMERIC BINDER HAVING ACID/BASE FUNCTIONALITY AND LIQUID TONERS FOR ELECTROPHOTOGRAPHIC APPLICATIONS"

U.S. Ser. No. 10/612,448, filed Jun. 30, 2003, entitled "GEL ORGANOSOL INCLUDING AMPHIPATHIC COPOLYMERIC BINDER HAVING HYDROGEN BONDING FUNCTIONALITY AND LIQUID TONERS FOR ELECTROPHOTOGRAPHIC APPLICATIONS"

U.S. Ser. No. 10/612,444, filed Jun. 30, 2003, entitled "GEL ORGANOSOL INCLUDING AMPHIPATHIC COPOLYMERIC BINDER HAVING CROSSLINKING FUNCTIONALITY AND LIQUID TONERS FOR ELECTROPHOTOGRAPHIC APPLICATIONS"

Advantageously, the S material of the copolymer serves as a graft stabilizer, or internal dispersant. Consequently, although separate dispersant material could be used to help mix the dry toner ingredients together, the use of a separate dispersant material is not needed, or even desirable, in preferred embodiments. Separate dispersants are less desirable as these tend to be humidity sensitive. Dry toner particles incorporating separate dispersant material may tend to have charging characteristics that vary with humidity changes. By avoiding separate dispersant material, it is believed that preferred embodiments of the present invention would show more stable charging characteristics with changes in humidity.

The visual enhancement additive(s) generally may include any one or more fluid and/or particulate materials that provide a desired visual effect when toner particles incorporating such materials is printed onto a receptor. Examples include one or more colorants, fluorescent materials, pearlescent materials, iridescent materials, metallic materials, flip-flop pigments, silica, polymeric beads, reflective and non-reflective glass beads, mica, combinations of these, and the like. The amount of visual enhancement additive incorporated into the triboelectrically charged particles may vary over a wide range. In representative embodiments, a suitable weight ratio of copolymer to visual enhancement additive is from 1/1 to 30/1, preferably from 3/1 to 20/1 and most preferably from 4/1 to 15/1.

Useful colorants are well known in the art and include materials such as dyes, stains, and pigments. Preferred colorants are pigments which may be combined with ingredients comprising the copolymer to interact with the D portion of the copolymer to form dry toner particles with structure as described herein, are at least nominally insoluble in and nonreactive with the carrier liquid, and are usefull and effective in making visible the latent electrostatic image. It is understood that the visual enhancement additive(s) may also interact with each other physically and/or chemically, forming aggregations and/or aggolmerates of visual enhancement additives that also interact with the D portion of the copolymer. Examples of suitable colorants include: phthalocyanine blue (C.I. Pigment Blue 15:1, 15:2, 15:3 and 15:4), monoarylide yellow (C.I. Pigment Yellow 1, 3, 65, 73 and 74), diarylide yellow (C.I. Pigment Yellow 12, 13, 14, 17 and 83), arylamide (Hansa) yellow (C.I. Pigment Yellow 10, 97, 105 and 111), azo red (C.I. Pigment Red 3, 17, 22, 23, 38, 48:1, 48:2, 52:1, 81 and 179), quinacridone magenta (C.I. Pigment Red 122, 202 and 209) and black pigments such as finely divided carbon (Cabot Monarch 120, Cabot Regal 300R, Cabot Regal 350R, Vulcan X72) and the like.

In addition to the visual enhancement additive, other additives optionally may be formulated into the triboelectrically charged particle formulation. A particularly preferred additive comprises at least one charge control agent. The charge control agent, also known as a charge director, helps to provide uniform charge polarity of the toner particles. The charge director may be incorporated into the toner particles using a variety of methods such as, copolymerizing a suitable monomer with the other monomers used to form the copolymer, chemically reacting the charge director with the toner particle, chemically or physically adsorbing the charge director onto the toner particle (resin or pigment), or chelating the charge director to a functional group incorporated into the toner particle. A preferred method is via a functional group built into the S material of the copolymer.

It is preferable to use an electric charge control agent that may be included as a separate ingredient and/or included as one or more functional moiety(ies) of S and/or D material incorporated into the amphipathic copolymer. The electric charge control agent is used to enhance the chargeability of the toner. The electric charge control agent may have either a negative or a positive electric charge. As representative examples of the electric charge control agent, there can be mentioned nigrosine NO1 (produced by Orient Chemical Co.), nigrosine EX (produced by Orient Chemical Co.), Aizen Spilon black TRH (produced by Hodogaya Chemical Co.), T-77 (produced by Hodogaya Chemical Co.), Bontron S-34 (produced by Orient Chemical Co.), and Bontron E-84 (produced by Orient Chemical Co.). The amount of the electric charge control agent, based on mg/g by weight of the amphipathic copolymer, is generally 1 to 100 parts by weight, preferably 1.0 to 50 parts by weight.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, combinations of these, and the like.

The particle size of the resultant triboelectrically charged particles may impact the imaging, fusing, resolution, and transfer characteristics of the toner incorporating such particles. Preferably, the primary particle size (determined with dynamic light scattering) of the particles is between about 0.05 and 50.0 microns, more preferably between 3 and 10 microns.

The liquid carrier may be selected from a wide range of aqueous or organic liquids, or combinations of these. Preferably, the liquid carrier comprises one or more organic liquids and is generally nonaqueous. Nonaqueous means that the liquid carrier includes less than 10 weight percent, preferably less than 5 weight percent, and more preferably less than 1 weight percent of water. In those embodiments of the invention in which the toner particles incorporate an amphipathic copolymer, the liquid carrier is selected such that at least one portion (also referred to herein as S material or block(s)) of the amphipathic copolymer is more solvated by the carrier while at least one other portion (also referred to herein as D material or block(s)) of the copolymer constitutes more of a dispersed phase in the carrier. In other words, preferred copolymers of the present invention comprise S and D material having respective solubilities in the desired liquid carrier that are sufficiently different from each other such that the S blocks tend to be more solvated by the carrier while the D blocks tend to be more dispersed in the carrier. More preferably, the S blocks are soluble in the liquid carrier while the D blocks are insoluble. In particularly preferred embodiments, the D material phase separates from the liquid carrier.

The solubility of a material, or a portion of a material such as a copolymeric block, may be qualitatively and quantitatively characterized in terms of its Hildebrand solubility parameter. The Hildebrand solubility parameter refers to a solubility parameter represented by the square root of the cohesive energy density of a material, having units of $(\text{pressure})^{1/2}$, and being equal to $(\Delta H\text{-}RT)^{1/2}/V^{1/2}$, where $\Delta H$ is the molar vaporization enthalpy of the material, R is the universal gas constant, T is the absolute temperature, and V is the molar volume of the solvent. Hildebrand solubility parameters are tabulated for solvents in Barton, A. F. M., *Handbook of Solubility and Other Cohesion Parameters,* 2d Ed. CRC Press, Boca Raton, Fla., (1991), for monomers and representative polymers in *Polymer Handbook,* 3rd Ed., J. Brandrup & E. H. Immergut, Eds. John Wiley, N.Y., pp 519-557 (1989), and for many commercially available polymers in Barton, A. F. M., *Handbook of Polymer-Liquid Interaction Parameters and Solubility Parameters*, CRC Press, Boca Raton, Fla., (1990).

The degree of solubility of a material, or portion thereof, in a liquid carrier may be predicted from the absolute difference in Hildebrand solubility parameters between the material, or portion thereof, and the liquid carrier. A material, or portion thereof, will be fully soluble or at least in a highly solvated state when the absolute difference in Hildebrand solubility parameter between the material, or portion thereof, and the liquid carrier is less than approximately 1.5 $MPa^{1/2}$. On the other hand, when the absolute difference between the Hildebrand solubility parameters exceeds approximately 3.0 $MPa^{1/2}$, the material, or portion thereof, will tend to phase separate from the liquid carrier. When the absolute difference in Hildebrand solubility parameters is between 1.5 $MPa^{1/2}$ and 3.0 $MPa^{1/2}$, the material, or portion thereof, is considered to be weakly solvated or marginally insoluble in the liquid carrier.

Consequently, in preferred embodiments, the absolute difference between the respective Hildebrand solubility parameters of the S block(s) of the copolymer and the liquid carrier is less than 3.0 $MPa^{1/2}$, preferably less than about 2.0 $MPa^{1/2}$, more preferably less than about 1.5 $MPa^{1/2}$. Additionally, it is also preferred that the absolute difference between the respective Hildebrand solubility parameters of the D block(s) of the copolymer and the liquid carrier is greater than 2.3 $MPa^{1/2}$, preferably greater than about 2.5 $MPa^{1/2}$, more preferably greater than about 3.0 $MPa^{1/2}$, with the proviso that the difference between the respective Hildebrand solubility parameters of the S and D block(s) is at least about 0.4 $MPa^{1/2}$, more preferably at least about 1.0 $mPa^{1/2}$. Because the Hildebrand solubility of a material may vary with changes in temperature, such solubility parameters are preferably determined at a desired reference temperature such as at 25° C.

Those skilled in the art understand that the Hildebrand solubility parameter for a copolymer, or portion thereof, may be calculated using a volume fraction weighting of the individual Hildebrand solubility parameters for each monomer comprising the copolymer, or portion thereof, as described for binary copolymers in Barton A. F. M., *Handbook of Solubility Parameters and Other Cohesion Parameters*, CRC Press, Boca Raton, p 12 (1990). The magnitude of the Hildebrand solubility parameter for polymeric materials is also known to be weakly dependent upon the weight average molecular weight of the polymer, as noted in Barton, pp 446-448. Thus, there will be a preferred molecular weight range for a given polymer or portion thereof in order to achieve desired solvating or dispersing characteristics. Similarly, the Hildebrand solubility parameter for a mixture may be calculated using a volume fraction weighting of the individual Hildebrand solubility parameters for each component of the mixture.

In addition, we have defined our invention in terms of the calculated solubility parameters of the monomers and solvents obtained using the group contribution method developed by Small, P. A., J. Appl. Chem., 3, 71 (1953) using Small's group contribution values listed in Table 2.2 on page VII/525 in the Polymer Handbook, 3rd Ed., J. Brandrup & E. H. Immergut, Eds. John Wiley, New York, (1989). We have chosen this method for defining our invention to avoid ambiguities which could result from using solubility parameter values obtained with different experimental methods. In addition, Small's group contribution values will generate solubility parameters that are consistent with data derived from measurements of the enthalpy of vaporization, and therefore are completely consistent with the defining expression for the Hildebrand solubility parameter. Since it is not practical to measure the heat of vaporization for polymers, monomers are a reasonable substitution.

For purposes of illustration, Table I lists Hildebrand solubility parameters for some common solvents used in an electrophotographic toner and the Hildebrand solubility parameters and glass transition temperatures (based on their high molecular weight homopolymers) for some common monomers used in synthesizing organosols.

TABLE I

Hildebrand Solubility Parameters
Solvent Values at 25° C.

| Solvent Name | Kauri-Butanol Number by ASTM Method D1133-54T (mL) | Hildebrand Solubility Parameter ($MPa_{1/2}$) |
|---|---|---|
| Norpar ™ 15 | 18 | 13.99 |
| Norpar ™ 13 | 22 | 14.24 |
| Norpar ™ 12 | 23 | 14.30 |
| Isopar ™ V | 25 | 14.42 |
| Isopar ™ G | 28 | 14.60 |
| Exxsol ™ D80 | 28 | 14.60 |

Source: Calculated from equation #31 of Polymer Handbook, 3rd Ed., J. Brandrup E. H. Immergut, Eds. John Wiley, NY, p. VII/522 (1989).

Monomer Values at 25° C.

| Monomer Name | Hildebrand Solubility Parameter ($MPa_{1/2}$) | Glass Transition Temperature (° C.)* |
|---|---|---|
| n-Octadecyl Methacrylate | 16.77 | −100 |
| n-Octadecyl Acrylate | 16.82 | −55 |
| Lauryl Methacrylate | 16.84 | −65 |
| Lauryl Acrylate | 16.95 | −30 |
| 2-Ethylhexyl Methacrylate | 16.97 | −10 |
| 2-Ethylhexyl Acrylate | 17.03 | −55 |
| n-Hexyl Methacrylate | 17.13 | −5 |
| t-Butyl Methacrylate | 17.16 | 107 |

TABLE I-continued

| | | |
|---|---|---|
| n-Butyl Methacrylate | 17.22 | 20 |
| n-Hexyl Acrylate | 17.30 | −60 |
| n-Butyl Acrylate | 17.45 | −55 |
| Ethyl Acrylate | 18.04 | −24 |
| Methyl Methacrylate | 18.17 | 105 |

Calculated using Small's Group Contribution Method, Small, P.A. Journal of Applied Chemistry 3 p. 71 (1953). Using Group Contributions from Polymer Handbook, 3rd Ed., J. Brandrup E. H. Immergut, Eds., John Wiley, NY, p. VII/525 (1989).
*Polymer Handbook, 3rd Ed., J. Brandrup E. H. Immergut, Eds., John Wiley, NY, pp. VII/209-277 (1989). The $T_g$ listed is for the homopolymer of the respective monomer.

The carrier liquid may be selected from a wide variety of materials, or combination of materials, which are known in the art, but preferably has a Kauri-butanol number less than 30 mL. The liquid is preferably oleophilic, chemically stable under a variety of conditions, and electrically insulating. Electrically insulating refers to a dispersant liquid having a low dielectric constant and a high electrical resistivity. Preferably, the liquid dispersant has a dielectric constant of less than 5; more preferably less than 3. Electrical resistivities of carrier liquids are typically greater than $10^9$ Ohm-cm; more preferably greater than $10^{10}$ Ohm-cm. In addition, the liquid carrier desirably is chemically inert in most embodiments with respect to the ingredients used to formulate the toner particles.

Examples of suitable liquid carriers include aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like) silicone oils and blends of these solvents. Preferred carrier liquids include branched paraffinic solvent blends such as Isopar™ G, Isopar™ H, Isopar™ K, Isopar™ L, Isopar™ M and Isopar™ V (available from Exxon Corporation, N.J.), and most preferred carriers are the aliphatic hydrocarbon solvent blends such as Norpar™ 12, Norpar™ 13 and Norpar™ 15 (available from Exxon Corporation, N.J.).

In electrophotographic and electrographic processes, an electrostatic image is formed on the surface of a photoreceptive element or dielectric element, respectively. The photoreceptive element or dielectric element may be an intermediate transfer drum or belt or the substrate for the final toned image itself, as described by Schmidt, S. P. and Larson, J. R. in Handbook of Imaging Materials Diamond, A. S., Ed: Marcel Dekker: New York; Chapter 6, pp 227-252, and U.S. Pat. Nos. 4,728,983, 4,321,404, and 4,268,598.

In electrography, a latent image is typically formed by (1) placing a charge image onto the dielectric element (typically the receiving substrate) in selected areas of the element with an electrostatic writing stylus or its equivalent to form a charge image, (2) applying toner to the charge image, and (3) fixing the toned image. An example of this type of process is described in U.S. Pat. No. 5,262,259. Images formed by the present invention may be of a single color or a plurality of colors. Multicolor images can be prepared by repetition of the charging and toner application steps.

In electrophotography, the electrostatic image is typically formed on a drum or belt coated with a photoreceptive element by (1) uniformly charging the photoreceptive element with an applied voltage, (2) exposing and discharging portions of the photoreceptive element with a radiation source to form a latent image, (3) applying a toner to the latent image to form a toned image, and (4) transferring the toned image through one or more steps to a final receptor sheet. In some applications, it is sometimes desirable to fix the toned image using a heated pressure roller or other fixing methods known in the art.

While the electrostatic charge of either the toner particles or photoreceptive element may be either positive or negative, electrophotography as employed in the present invention is preferably carried out by dissipating charge on a positively charged photoreceptive element. A positively-charged toner is then applied to the regions in which the positive charge was dissipated using a dry toner development technique.

The substrate for receiving the image from the photoreceptive element can be any commonly used receptor material, such as paper, coated paper, polymeric films and primed or coated polymeric films. Polymeric films include plasticized and compounded polyvinyl chloride (PVC), acrylics, polyurethanes, polyethylene/acrylic acid copolymer, and polyvinyl butyrals. Commercially available composite materials such as those having the trade designations Scotchcal™, Scotchlite™, and Panaflex™ are also suitable for preparing substrates.

The present invention will now be further described with reference to the following illustrative examples.

EXAMPLES

1. Glossary of Chemical Abbreviations & Chemical Sources

The following raw materials were used to prepare the polymers in the examples which follow:

AIBN: Azobisisobutyronitrile (a free radical forming initiator available as VAZO-64 from DuPont Chemical Co., Wilmington, Del.)

nBA: normal-Butyl acrylate (available from Aldrich Chemical Co., Milwaukee, Wis.)

DMAEMA: 2-Dimethylaminoethyl methacrylate (available from Aldrich Chemical Co., Milwaukee, Wis.)

EMAAD: N-ethyl-2-methylallyamine (available from Aldrich Chemical Co., Milwaukee, Wis.)

EMA: Ethyl methacrylate (available from Aldrich Chemical Co., Milwaukee, Wis.)

HEMA: 2-Hydroxyethyl methacrylate (available from Aldrich Chemical Co., Milwaukee, Wis.)

MAA: Methacrylate acid (Aldrich Chemical Co., Milwaukee, Wis.)

St: Styrene (available from Aldrich Chemical Co., Milwaukee, Wis.)

TCHMA: Trimethyl cyclohexyl methacrylate (available from Ciba Specialty Chemical Co., Suffolk, Va.)

TMI: Dimethyl-m-isopropenyl benzyl isocyanate (available from CYTEC Industries, West Paterson, N.J.)

V-601 initiator: Dimethyl 2,2'-azobisisobutyrate (a free radical forming initiator available under the trade designation V-601 from WAKO Chemicals U.S.A., Richmond, Va.)

Zirconium HEX-CEM: (metal soap, zirconium tetraoctoate, available from OMG Chemical Company, Cleveland, Ohio)

Test Methods

The following test methods were used to characterize the polymer and toner samples in the examples that follow:

Solids Content of Solutions

In the following toner composition examples, percent solids of the graft stabilizer solutions, the organosol, and milled liquid toner dispersions were determined thermogravimetrically by drying an originally-weighed, wet sample in an aluminum weighing pan at 160° C. for two to three hours, weighing the dried sample, and determining the resultant weight loss such as by calculating the percentage ratio of the dried sample weight to the original sample weight, after accounting for the weight of the aluminum weighing pan. Approximately two grams of wet sample were used in each determination of percent solids using this thermo-gravimetric method.

Graft Stabilizer Molecular Weight

Various properties of the graft stabilizer have been determined to be important to the performance of the stabilizer, including molecular weight and molecular weight polydispersity. Graft stabilizer molecular weight is normally expressed in terms of the weight average molecular weight ($M_w$), while molecular weight polydispersity is given by the ratio of the weight average molecular weight to the number average molecular weight ($M_w/M_n$). Molecular weight parameters were determined for graft stabilizers with gel permeation chromatography (GPC) using tetrahydrofuran as the carrier solvent. Absolute $M_w$ was determined using a Dawn DSP-F light scattering detector (commercially obtained from Wyatt Technology Corp, Santa Barbara, Calif.), while polydispersity was evaluated by ratioing the measured $M_w$ to a value of $M_n$ determined with an Optilab 903 differential refractometer detector (commercially obtained from Wyatt Technology Corp, Santa Barbara, Calif.).

Particle Size

The organosol particle size distributions were determined using a Horiba LA-920 laser diffraction particle size analyzer (commercially obtained from Horiba Instruments, Inc, Irvine, Calif.) using Norpar™ 12 fluid that contains 0.1% Aerosol OT (dioctyl sodium sulfosuccinate, sodium salt, Fisher Scientific, Fairlawn, N.J.) surfactant. The dry toner particle size distributions were determined using a Horiba LA-900 laser diffraction particle size analyzer (commercially obtained from Horiba Instruments, Inc, Irvine, Calif.) using de-ionized water that contains 0.1% Triton X-100 surfactant (available from Union Carbide Chemicals and Plastics, Inc., Danbury, Conn.).

In both procedures, the samples were diluted by approximately 1 part sample in 500 parts additional liquid carrier by volume and sonicated for one minute at 150 watts and 20 kHz prior to measurement. The particle size was expressed on a number-average basis in order to provide an indication of the fundamental (primary) particle size of the particles.

Toner Charge (Blow-off Q/M (Katun))

One important characteristic of xerographic toners is the toner's electrostatic charging performance (or specific charge), given in units of Coulombs per gram. The specific charge of each toner was established in the examples below using a blow-off tribo-tester instrument (Toshiba Model TB200 Blow-Off Powder Charge measuring apparatus with size #400 mesh stainless steel screens pre-washed in tetrahydrofuran and dried over nitrogen, Toshiba Chemical Co., Tokyo, Japan). To use this device, the toner was first electrostatically charged by combining it with a carrier powder. The carrier is a ferrite powder coated with a polymeric shell. The toner and the coated carrier particles were brought together to form the developer in a plastic container. When the developer was gently agitated using a U.S. Stoneware mill mixer, tribocharging results in both of the component powders acquiring an equal and opposite electrostatic charge, the magnitude of which is determined by the properties of the toner and carrier, along with any compounds optionally added to the toner to affect the charging and flowability (e.g., charge control agents, silica, and the like in accordance with conventional practices).

Once charged, the developer mixture was placed in a small holder inside the blow-off tribo-tester. The holder acts as a charge-measuring Faraday cup that is attached to a sensitive capacitance meter. The cup has a connection to a compressed dry nitrogen gas line and a fine screen at its base that is sized to retain the larger carrier particles while allowing passage of the smaller toner particles. When the gas line is pressurized, gas flows though the cup and forces the toner particles out of the cup through the fine screen. The carrier particles remain in the Faraday cup. The capacitance meter in the tester measures the charge of the carrier where the charge on the toner that was removed is equal in magnitude and opposite in sign. A measurement of the amount of toner mass lost yields the toner specific charge, in microCoulombs per gram of developer.

For the present measurements, a polyvinylidene fluoride (PVDF) coated ferrite carrier (Canon 3000-4000 carrier, K101, Type TefV 150/250, Japan) with a mean particle size of about 150 microns was used. Toner samples (0.5 g per sample) were mixed with a carrier powder (9.5 g, Canon 3000-4000 carrier, K101, Type TefV 150/250, Japan)) to obtain a 5-weight percent toner content in the developer. This developer was gently agitated using a U.S. Stoneware mill mixer for 5 min, 15 min, and 30 min intervals before 0.2 g of the toner/carrier developer was analyzed using a Toshiba Blow-off tester to obtain the specific charge (in microCoulombs/gram) of each developer. Specific charge measurements were repeated at least three times for each toner to obtain a mean value and a standard deviation. The data was monitored for quality, namely, a visual observation that nearly all of the toner was blown-off of the carrier during the measurement. Tests were considered valid if nearly all of toner mass is blown-off from the carrier beads. Tests with low mass loss are rejected.

Conventional Differential Scanning Calorimetry

Thermal transition data for synthesized toner material was collected using a TA Instruments Model 2929 Differential Scanning Calorimeter (New Castle, Del.) equipped with a DSC refrigerated cooling system (−70° C. minimum temperature limit) and dry helium and nitrogen exchange gases. The calorimeter ran on a Thermal Analyst 2100 workstation with version 8.10B software. An empty aluminium pan was used as the reference. The samples were prepared by placing 6.0 to 12.0 mg of the experimental material into an aluminum sample pan and crimping the upper lid to produce a hermetically sealed sample for DSC testing. The results were normalized on a per mass basis. Each sample was evaluated using 10° C./min heating and cooling rates with a 5-10 min isothermal bath at the end of each heating or cooling ramp. The experimental materials were heated five times: the first heat ramp removes the previous thermal history of the sample and replaces it with the 10° C./min cooling treatment and subsequent heat ramps are used to obtain a stable glass transition temperature value—values were reported from either the third or fourth heat ramp.

NOMENCLATURE

In the following examples, the compositional details of each copolymer will be summarized by ratioing the weight percentages of monomers used to create the copolymer. The grafting site composition is expressed as a weight percentage of the monomers comprising the copolymer or copolymer precursor, as the case may be. For example, a graft stabilizer (precursor to the S portion of the copolymer) designated TCHMA/HEMA-TMI (97:3-4.7) is made by copolymerizing, on a relative basis, 97 parts by weight TCHMA and 3 parts by weight HEMA, and this hydroxy functional co-polymer was reacted with 4.7 parts by weight of TMI.

Similarly, a graft copolymer organosol designated TCHMA/HEMA-TMI//EMA (97:3-4.7//100) is made by copolymerizing the designated graft stabilizer (TCHMA/HEMA-TMI (97:3-4.7)) (S portion or shell) with the designated core monomer EMA (D portion or core, 100% EMA) at a specified ratio of D/S (core/shell) determined by the relative weights reported in the examples.

Graft Stabilizer Preparation

Examples 1 and 2, which follow, describe the preparation of two graft stabilizer embodiments having characteristics as summarized in the following table:

TABLE 1

| Examples | Graft Stabilizer Designation | Percent Solids | Molecular Weight $M_w$ | $M_w/M_n$ |
|---|---|---|---|---|
| 1 | TCHMA/HEMA-TMI (97/3-4.7% w/w) | 26.2 | 251,300 | 2.8 |
| 2 | TCHMA/HEMA-TMI (97/3-4.7% w/w) | 25.4 | 299,100 | 2.6 |

Example 1

A 190 liter reactor equipped with a condenser, a thermocouple connected to a digital temperature controller, a nitrogen inlet tube connected to a source of dry nitrogen, and a mixer was charged with a mixture of 91.6 kg of Norpar™ 12 fluid, 30.1 kg of TCHMA, 0.95 kg of 98 wt % HEMA, and 0.39 kg of V-601. While stirring the mixture, the reactor was purged with dry nitrogen for 30 minutes at flow rate of approximately 2 liters/minute, and then the nitrogen flow rate was reduced to approximately 0.5 liters/min. The mixture was heated to 75° C. for 4 hours. The conversion was quantitative.

The mixture was heated to 100° C. for 1 hour to destroy any residual V-601 initiator and then was cooled back to 70° C. The nitrogen inlet tube was then removed and 0.05 kg of 95% DBTDL was added to the mixture. Next, 1.47 kg of TMI was gradually added over the course of approximately 5 minutes into the continuously stirred reaction mixture. The mixture was allowed to react at 70° C. for 2 hours, at which time the conversion was quantitative.

The mixture was then cooled to room temperature to produce a viscous, transparent liquid containing no visible insoluble mater. The percent solids of the liquid mixture was determined to be 26.2 wt % using the drying method described above. Subsequent determination of molecular weight was made using the GPC method described above: the copolymer had an $M_w$ of 251,300 Da and $M_w/M_n$ of 2.8 based on two independent measurements. The product is a copolymer of TCHMA and HEMA containing random side chains of TMI attached to the HEMA and is designated herein as TCHMA/HEMA-TMI (97/3-4.7% w/w) and can be used to make an organosol. The shell co-polymer had a $T_g$ of 120° C.

Example 2

A 190 liter reactor equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with 88.45 kg of Norpar™12 fluid, by vacuum. The vacuum was then broken and a flow of 28.32 liter/hr of nitrogen applied and the agitation is started at 70 RPM. Next, 30.12 kg of TCHMA was added and the container rinsed with 1.22 kg of Norpar™12 fluid and 0.95 kg of 98 wt % HEMA was added and the container rinsed with 0.62 kg of Norpar™12 fluid. Finally, 0.39 kg of V-601 initiator was added and the container rinsed with 0.091 kg of Norpar™12 fluid. A full vacuum was then applied for 10 minutes, and then broken by a nitrogen blanket. A second vacuum was pulled for 10 minutes, and then agitation stopped to verify that no bubbles were coming out of the solution. The vacuum was then broken with a nitrogen blanket and a light flow of nitrogen of 28.32 liter/hr was applied. Agitation was resumed at 70 RPM and the mixture was heated to 75° C. and held for 4 hours. The conversion was quantitative.

The mixture was heated to 100° C. and held at that temperature for 1 hour to destroy any residual V-601 initiator, and then was cooled back to 70° C. The nitrogen inlet tube was then removed, and 0.05 kg of 95 wt % DBTDL was added to the mixture using 0.62 kg of Norpar™12 fluid to rinse container, followed by 1.47 kg of TMI. The TMI was added continuously over the course of approximately 5 minutes while stirring the reaction mixture and the container was rinsed with 0.64 kg of Norpar™12 fluid. The mixture was allowed to react at 70° C. for 2 hours, at which time the conversion was quantitative.

The mixture was then cooled to room temperature. The cooled mixture was a viscous, transparent liquid containing no visible insoluble matter. The percent solids of the liquid mixture were determined to be 25.4 wt % using the Thermogravimetric method described above. Subsequent determination of molecular weight was made using the GPC method described above; the copolymer had a $M_w$ of 299,100 and $M_w/M_n$ of 2.6 based on two independent measurements. The product is a copolymer of TCHMA and HEMA with a TMI grafting site and is designed herein as TCHMA/HEMA-TMI (97/3-4.7% w/w) and can be used to make an organosol containing no polar groups in the shell composition. The glass transition temperature was measured using DSC, as described above. The shell co-polymer had a $T_g$ of 115° C.

Organosol Preparations

Examples 3 through 6, which follow, describe the preparation of organosol embodiments having characteristics as summarized in the following table:

TABLE 2

| Example # | Organosol Description (w/w %) | Particle Size (μm) | % solids (wt %) | Glass Transition Temperature (° C.) |
|---|---|---|---|---|
| 3 | TCHMA/HEMA-TMI//St/nBA/MAA 97:3-4.7//78.4:15.9:5.7 | 10.3 | 18% | 68.5 |
| 4 | TCHMA/HEMA-TMI//EMA/EMAAD 97/3-4.7//91.9:8.1 | 35.9 | 17% | 69.0 |

TABLE 2-continued

| Example # | Organosol Description (w/w %) | Particle Size (μm) | % solids (wt %) | Glass Transition Temperature (° C.) |
|---|---|---|---|---|
| 5 | TCHMA/HEMA-TMI//EMA/DMAEMA 97/3-4.7//91.9:8.1 | 36.9 | 18% | 70.0 |
| 6 | TCHMA/HEMA-TMI//EMA (97/3-4.7//100% w/w) | 42.3 | 13.3% | 62.7 |

Example 3

This is an example using the graft stabilizer in Example 1 to prepare an organosol containing no polar groups and having a core/shell ratio of 8/1. A 5000 ml 3-neck round flask equipped with a condenser, a thermocouple connected to a digital temperature controller, a nitrogen inlet tube connected to a source of dry nitrogen and a mechanical stirrer, was charged with a mixture of 2573 g of Norpar™ 12 fluid, 296.86 g of the graft stabilizer mixture from Example 1 @ 26.2% polymer solids, 486.08 g of St, 98.81 g of nBA, 35.09 g of MAA and 10.50 g of AIBN. While stirring the mixture, the reaction flask was purged with dry nitrogen for 30 minutes at flow rate of approximately 2 liters/minute. A hollow glass stopper was then inserted into the open end of the condenser and the nitrogen flow rate was reduced to approximately 0.5 liters/minute. The mixture was heated to 70° C. for 16 hours. The conversion was quantitative.

Approximately 350 g of n-heptane was added to the cooled organosol. The resulting mixture was stripped of residual monomer using a rotary evaporator equipped with a dry ice/acetone condenser and operating at a temperature of 90° C. and using a vacuum of approximately 15 mm Hg. The stripped organosol was cooled to room temperature, yielding an opaque white dispersion.

This organosol was designated (TCHMA/HEMA-TMI//St/nBA/MAA) (97:3-4.7//78.4:15.9:5.7 w/w %) c/s8 and can be used to prepare toner formulations which had no polar groups. The percent solids of the organosol dispersion after stripping was determined to be 18 wt % using the thermogravimetric method described above. Subsequent determination of average particles size of the wet particles was made using the laser diffraction method described above. The dispersed particles in the organosol had a volume average diameter of 10.3 μm. The wet organosol polymer had an effective $T_g$ of 68.5° C.

Example 4

This example illustrates the use of the graft stabilizer in Example 1 to prepare an organosol containing secondary amine groups in the core and having a core/shell ratio of 8.7/1. Using the method and apparatus of Example 2,2614 g of Norpar™ 12, 267.18 g of the graft stabilizer mixture from Example 1 @ 26.2% polymer solids, 560 g of EMA, 49.63 g of EMAAD, and 9.45 g of V601 initiator were combined. The mixture was heated to 70° C. for 16 hours. The conversion was quantitative. The mixture then was cooled to room temperature. After stripping the organosol using the method of Example 2 to remove residual monomer, the stripped organosol was cooled to room temperature, yielding an opaque white dispersion. This organosol was designated (TCHMA/HEMA-TMI//EMA/EMAAD) (97/3-4.7//91.9:8.1) c/s 8.7 and can be used to prepare toner formulations which have polar functional groups. The percent solids of the organosol dispersion after stripping was determined to be 17 wt % using the drying method described above. Subsequent determination of average particles size was made using the laser diffraction method described above. The organosol had a volume average diameter of 35.9 μm. The glass transition temperature was measured using DSC, as described above. The organosol polymer had a $T_g$ of 69° C.

Example 5

This example illustrates the use of the graft stabilizer in Example 1 to prepare an organosol containing tertiary amine groups in the core and having a core/shell ratio of 8/1. Using the method and apparatus of Example 2, 2614 g of Norpar™ 12, 267.18 g of the graft stabilizer mixture from Example 1 @ 26.2% polymer solids, 560 g of EMA, 49.63 g of DMAEMA, and 9.45 g of V601 initiator were combined. The mixture was heated to 70° C. for 16 hours. The conversion was quantitative. The mixture then was cooled to room temperature. After stripping the organosol using the method of Example 2 to remove residual monomer, the stripped organosol was cooled to room temperature, yielding an opaque white dispersion. This organosol was designated (TCHMA/HEMA-TMI//EMA/DMAEMA) (97/3-4.7//91.9:8.1) c/s 8.7 and can be used to prepare toner formulations which have polar functional groups. The percent solids of the organosol dispersion after stripping was determined to be 18 wt % using the drying method described above. Subsequent determination of average particles size was made using the laser diffraction method described above. The organosol had a volume average diameter of 36.9 μm. The glass transition temperature was measured using DSC, as described above. The organosol polymer had a $T_g$ of 70° C.

Example 6

A 2120 liter reactor, equipped with a condenser, a thermocouple connected to a digital temperature controller, a nitrogen inlet tube connected to a source of dry nitrogen and a mixer, was thoroughly cleaned with a heptane reflux and then thoroughly dried at 100° C. under vacuum. A nitrogen blanket was applied and the reactor was allowed to cool to ambient temperature. The reactor was charged with a mixture of 689 kg of Norpar™12 fluid and 43.0 kg of the graft stabilizer mixture from Example 2 @ 25.4 wt % polymer solids along with an additional 4.3 kg of Norpar™12 fluid to rinse the pump. Agitation was then turned on at a rate of 65 RPM, and temperature was check to ensure maintenance at ambient. Next, 92 kg of EMA was added along with 12.9 kg of Norpar™12 fluid for rinsing the pump. Finally, 1.0 kg of V-601 initiator was added, along with 4.3 kg of Norpar™12 fluid to rinse the container. A 40 torr vacuum was applied for 10 minutes and then broken by a nitrogen blanket. A second vacuum was pulled at 40 torr for an additional 10 minutes, and then agitation stopped to verify that no bubbles were coming out of the solution. The vacuum was then broken with a nitrogen blanket and a light flow of nitrogen of 14.2 liter/min was applied. Agitation of 75 RPM was resumed and the temperature of the reactor was heated to 75° C. and maintained for 5 hours. The conversion was quantitative.

The resulting mixture was stripped of residual monomer by adding 86.2 kg of n-heptane and 172.4 kg of Norpar™12 fluid and agitation was held at 80 RPM with the batch heated to 95° C. The nitrogen flow was stopped and a vacuum of 126 torr was pulled and held for 10 minutes. The vacuum was then increased to 80, 50, and 31 torr, being held at each level for 10 minutes. Finally, the vacuum was increased to 20 torr and held for 30 minutes. At that point a full vacuum is pulled and 360.6 kg of distillate was collected. A second strip was performed, following the above procedure and 281.7 kg of distillate was collected. The vacuum was then broken and the stripped organosol was cooled to room temperature, yielding an opaque white dispersion.

This organosol is designed TCHMA/HEMA-TMI//EMA (97/3-4.7//100% w/w). The percent solid of the organosol dispersion after stripping was determined as 13.3 wt % by the Thermogravimetric method described above. Subsequent determination of average particles size was made using the light scattering method described above. The organosol particle had a volume average diameter of 42.3 μm. The glass transition temperature of the organosol polymer was measured using DSC, as described above, was 62.7° C.

Preparation of Liquid Inks

Example 7

This example illustrates the use of the organosol in Example 3 to prepare a liquid toner. 1571 g of organosol @ 18% (w/w) solids in Norpar™ 12 fluid was combined with 577 g of Norpar™ 12 fluid, 47 g of Cabot Black Pigment Mogul L (Cabot Corporation, Billerica, Mass.), and 4.43 g of 26.6% Zirconium HEX-CEM solution (OMG Chemical Company, Cleveland, Ohio). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 20 minutes. The percent solids of the toner concentrate was determined to be 15.3% (w/w) using the drying method described above and exhibited a volume mean particle size of 9.44 microns. Average particle size was made using the laser diffraction method described above.

Example 8

This example illustrates the use of the organosol in Example 4 to prepare a liquid toner. 1626 g of organosol @ 17.4% (w/w) solids in Norpar™ 12 was combined with 523 g of Norpar™ 12, 47 g of Black pigment (Aztech EK8200, Magruder Color Company, Tucson, Ariz.) and 4.33 g of 26.61% Zirconium HEX-CEM solution (OMG Chemical Company, Cleveland, Ohio). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 4 minutes. The percent solids of the toner concentrate was determined to be 13.6% (w/w) using the drying method described above and exhibited a volume mean particle size of 3.9 microns. Average particle size was made using the laser diffraction method described above.

Example 9

This example illustrates the use of the organosol in Example 5 to prepare a liquid toner. 1537 g of organosol @ 18.4% (w/w) solids in Norpar™ 12 was combined with 611 g of Norpar™ 12, 47 g of Black pigment (Aztech EK8200, Magruder Color Company, Tucson, Ariz.) and 4.43 g of 26.61% Zirconium HEX-CEM solution (OMG Chemical Company, Cleveland, Ohio). This mixture was then milled in a Hockmeyer HSD Immersion Mill (Model HM-1/4, Hockmeyer Equipment Corp. Elizabeth City, N.C.) charged with 472.6 g of 0.8 mm diameter Yttrium Stabilized Ceramic Media. The mill was operated at 2000 RPM with chilled water circulating through the jacket of the milling chamber temperature at 21° C. Milling time was 25 minutes. The percent solids of the toner concentrate was determined to be 14.6% (w/w) using the drying method described above and exhibited a volume mean particle size of 9.0 microns. Average particle size was made using the laser diffraction method described above.

Example 10

This is an example of preparing a black liquid toner using the organosol from Example 6. 12,759 g of the organosol from Example 6 @ 13.10% (w/w) solids in Norpar™ 12 were combined with 1932 g of Norpar™ 12, 279 g of Pigment Black EK8200 (Aztech Company, Tucson, Ariz.) and 29.95 g of 27.90% Zirconium HEX-CEM solution (OMG Chemical Company, Cleveland, Ohio). This mixture was then milled in a 1 gallon Hockmeyer mill (Model HSD Mill, Hockmeyer Equipment Corp., Elizabeth City, N.C.), charged with 4,175 g of 0.8 mm diameter Yttrium Stabilized Ceramic Media. The mill was operated at 2000 RPM for 60 minutes with hot water circulating through the jacket of the milling chamber at 80° C.

The particle size of the liquid toner was measured using a Horiba LA-900 laser diffraction particle size analyzer (Horiba Instruments, Inc., Irvine, Calif.) as described above. The liquid toner had a volume mean particle size of 4.1 microns.

Example 11

This is an example of preparing a magenta liquid toner using the organosol from Example 6. 13,025 g of the organosol from Example 6 @ 13.10% (w/w) solids in Norpar™ 12 were combined with 1705 g of Norpar™ 12, 244 g of Pigment Red 81:4 (McGruder Color Company, Tucson, Ariz.) and 26.21 g of 27.90% Zirconium HEX-CEM solution (OMG Chemical Company, Cleveland, Ohio). This mixture was then milled in a 1 gallon Hockmeyer mill (Model HSD Mill, Hockmeyer Equipment Corp., Elizabeth City, N.C.), charged with 4,175 g of 0.8 mm diameter Yttrium Stabilized Ceramic Media. The mill was operated at 2000 RPM for 60 minutes with hot water circulating through the jacket of the milling chamber at 80° C.

The particle size of the liquid toner was measured using a Horiba LA-900 laser diffraction particle size analyzer (Horiba Instruments, Inc., Irvine, Calif.) as described above. The liquid toner had a volume mean particle size of 3.2 microns.

Preparation of Dry Toner

Example 12

The liquid inks described In Examples 7, 8, and 9 above were respectively dried using representative principles of the present invention. In each experiment, a coating apparatus (web coater Model No. 1060 commercially available from T.H. Dixon and Co., Ltc., Hertfordshire, England) was adapted for use in the present invention in accordance with FIG. 1. The coating apparatus ("coater"), which typically uses an extrusion head to coat materials onto a passing substrate, was modified to include a preferred coating station per FIG. 1 instead of the extrusion head. Thus, the coating station, described in greater detail above, included an ink tank or reservoir holding the ink sample being tested (i.e., ingredients comprising charged toner particles dispersed in a dielectric carrier liquid), and an electrically biased deposition roller for carrying the wet charged toner particles into proximity of the web, which was grounded. A coating station roller opposed the deposition roller to help maintain the desired gap between the deposition roller and the web surface.

The deposition roller was rotated to establish a surface speed of at least 2.8 inches/sec, or higher as needed, in order to ensure that adequate liquid toner was kept in the gap between the deposition roller and the web. In these experiments, (and based on the ink properties described below), that gap was set at 10 mils (250 micrometers).

The web used for these experiments was obtained from CP Films, Inc. (Martinsville, Va.). The web was made by vapor coating aluminum onto a continuous web of 4 mil thick Dupont A film. The amount of aluminum coated substantially evenly onto the web was sufficient to achieve a resistivity reading of no more than 1 Ohm/sq. The web traveled at 5 feet (1.5 m) per minute and was grounded. The voltage applied to the deposition roller by a voltage source was 100 V. During coating operations, the liquid ink particles, having a positive charge, were repelled by the deposition roller and were more attracted to the grounded aluminum of the web, where they were plated thereon by that attraction. The percent solids of the liquid ink admixture was between 10-15% wt. and the average particle size was about 3-10 μm.

After the sample was coated onto the moving web, a single calendaring roll such as roll 36 was used to even out the thickness of the toner layer. The calendering roller was set to a bias of 150V to discourage the positively charged particles from transferring off of the grounded web.

Downstream from the coating station, the web passed through a drying station which included an oven, which was set at 40° C. The path of the web through the oven was about 20 feet (6.1 m) long.

As the web exited the oven, it was passed through a de-ionizing zone to dissipate any possible dangerous charge it may have picked up during the drying process. The dried toner particles were then collected at a particle recovery station using a brush and vacuum that removed the dried particles from the web and trapped then in a bag.

The dried toner particles were subjected to testing to evaluate charging performance. The results of that testing for each of the dried toners is shown below.

TABLE

| Example | $D_v$ | Dried Toner Charge Q/M (μC/g) | | |
|---|---|---|---|---|
| # | (μm) | 5 min | 15 min | 30 min |
| 7 | 4.5 | 2.49 | 4.79 | 6.31 |
| 8 | 3.9 | 40.70 | 53.97 | 77.91 |
| 9 | 9.0 | 56.44 | 62.34 | 63.90 |

The following Examples 13 and 14 show how the drying process of the present invention has little impact upon particle size distribution.

Example 13

An organosol magenta liquid toner from Example 11 containing 13 weight percent of toner particles was dried using the procedure of Example 12. The following data was obtained, indicating that the fine, particulate nature of the organosol particles is preserved upon drying using the methodology of the present invention, wherein:

$a_0$ (%) is the % solids of the liquid toner;

$a_1$ (%) is the % solids of the toner paste on the web after calendaring:

$a_2$ (%) is the % solids of the dried toner particles

Tg is the glass transition temperature of the dried toner particles $D_V$ is the mean value of volume averaged particle sizes $D_N$ is the mean value of number averaged particle sizes

| $a_0$ (%) | $a_1$ (%) | $a_2$ (%) | Tg (° C.) |
|---|---|---|---|
| 13 | 17.9 | 95.43 | 69.2 |
| | Liquid | Dry | |
| Dispersion Medium | Norpar | Norpar | Water |
| $D_V$ (micrometers) | 2.94 | 2.88 | 3.94 |
| $D_N$ (micrometers | 1.39 | 1.13 | 0.963 |

Example 14

The procedure of Example 12 was repeated using an organosol black liquid toner from Example 10 containing 13.5 weight percent of toner particles. The following data was obtained, showing that the dried toner was well dispersed:

| $a_0$ (%) | $a_1$ (%) | $a_2$ (%) | Tg (° C.) |
|---|---|---|---|
| 13.5 | 19 | 98.1 | 74.7 |
| | Liquid | Dry | |
| Dispersion Medium | Norpar | Norpar | Water |
| $D_V$ (micrometers) | 2.673 | 3.016 | 6.424 |
| $D_N$ (micrometers | 1.314 | 1.291 | 1.422 |

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims.

All patents, patent documents, and publications cited herein are hereby incorporated by reference as if individually incorporated.

What is claimed is:

1. A method of drying charged toner particles, comprising the steps of:

(a) providing an admixture comprising the charged toner particles dispersed in a liquid carrier;

(b) using an electrical characteristic of a surface to help coatingly transfer the toner particles onto the surface;

(c) while the toner particles are coated onto the surface, at least partially drying the toner particles; and (d) collecting the toner particles and incorporating the collected particles into an electrophotographic toner.

2. The method of claim 1, wherein the toner particles are chemically charged.

3. The method of claim 1, wherein the electrophotographic toner is a dry toner.

4. The method of claim 1, wherein the liquid carrier is substantially nonaqueous.

5. The method of claim 1, wherein the liquid carrier has a kauri butanol number of less than about 30.

6. The method of claim 1, wherein the liquid carrier comprises an organic liquid.

7. The method of claim 1, wherein the electrical characteristic comprises an electrical bias.

8. The method of claim 1, wherein the toner particles comprise a binder derived from one or more ingredients comprising an amphipathic copolymer.

9. The method of claim 1, wherein step (b) comprises forming a coating containing the toner particles on the surface, said coating having a thickness up to about 250 micrometers.

10. The method of claim 1, wherein step (b) comprises forming a coating containing the toner particles on the surface, said coating having a thickness up to about 100 micrometers.

11. The method of claim 1, wherein step (b) comprises forming a coating containing the toner on the surface, wherein the toner particles have an average diameter, and wherein said coating has an average thickness as coated up to about ten times the average diameter of the toner particles.

12. The method of claim 1, wherein the coating has an average thickness as coated of up to about five times the average diameter of the toner particles.

13. The method of claim 1, wherein step (b) comprises the steps of electrophoretically plating the toner particles directly on the surface.

14. The method of claim 1, wherein step (b) comprises the steps of transferring the toner particles to a roller and then plating the toner particles from the roller to the surface.

15. The method of claim 1, wherein the coating of toner particles on the surface is at least substantially continuous.

16. The method of claim 1, wherein the coating of toner particles on the surface is discontinuous.

17. The method of claim 1, wherein the coating of toner particles is patterned.

18. The method of claim 1, wherein the roller and the surface are each electrically biased in a manner effective to help facilitate plating of the toner particles from the admixture to the surface.

19. The method of claim 1, wherein the drying step occurs under conditions such that coalescence of toner particles is at least substantially avoided.

20. The method of claim 1, wherein the drying step occurs at a temperature below an effective $T_g$ of the wet toner particles.

21. The method of claim 1, wherein the drying step occurs at a temperature in the range of from about 5° C. below to about 15° C. below an effective $T_g$ of the wet toner particles.

22. The method of claim 1, wherein the surface constitutes a portion of a moving web.

23. The method of claim 22, wherein the web is continuous.

24. The method of claim 22, wherein the web is conveyed from a supply roll to a take up roll.

25. The method of claim 1, wherein the surface constitutes a portion of a moving, electrically biased web.

26. The method of claim 1, wherein step (d) comprises recovering the at least partially dried toner particles from the surface.

27. The method of claim 26, wherein said recovering step comprises using a vacuum to help motivate the toner particles from the surface.

28. The method of claim 26, wherein said recovering step comprises physically dislodging the toner particles from the surface.

29. The method of claim 28, wherein said dislodging comprises brushing the toner particles from the surface.

30. A method of providing an electrophotographic toner product, comprising the steps of:

(a) providing an admixture comprising a plurality of charged toner particles dispersed in a liquid carrier;

(b) transferring a portion of the admixture to an electrically biased, moving web;

(c) at least partially drying the coated toner particles;

(d) incorporating the dried toner particles into an electrophotographic toner product; and (e) marketing the electrophotographic toner product for use in an imaging process.

31. The method of claim 30, wherein step (b) comprises accumulating a portion of the admixture on an electrically biased roller and then plating the toner particles from the electrically biased roller to the electrically biased moving web.

32. The method of claim 31, wherein the roller and web each have surfaces moving at speeds such that the roller surface speed is greater than the web surface speed.

33. The method of claim 31, wherein the ratio of the roller surface speed to the web surface speed is in the range from greater than 1:1 to about 3:1.

* * * * *